US010814218B2

(12) United States Patent
Wei

(10) Patent No.: US 10,814,218 B2
(45) Date of Patent: Oct. 27, 2020

(54) CONTROL METHOD OF CLAW MACHINE

(71) Applicant: PAOKAI ELECTRONIC ENTERPRISE CO., LTD., Kaohsiung (TW)

(72) Inventor: Ming-Shan Wei, Kaohsiung (TW)

(73) Assignee: PAOKAI ELECTRONIC ENTERPRISE CO., LTD., Kaohsiung (TW)

( * ) Notice: Subject to any disclaimer, the term of this patent is extended or adjusted under 35 U.S.C. 154(b) by 0 days.

(21) Appl. No.: 16/365,750

(22) Filed: Mar. 27, 2019

(65) Prior Publication Data

US 2020/0306623 A1 Oct. 1, 2020

(51) Int. Cl.
*A63F 9/30* (2006.01)
*G07F 17/32* (2006.01)

(52) U.S. Cl.
CPC ..... *A63F 9/30* (2013.01); *G07F 17/3216* (2013.01); *G07F 17/3297* (2013.01)

(58) Field of Classification Search
CPC ..... A63F 9/30; G07F 17/3297; G07F 17/3216
USPC ..... 273/448
See application file for complete search history.

(56) References Cited

U.S. PATENT DOCUMENTS 6,851,674 B2 * 2/2005 Pierce ..... A63F 7/022 273/121 B
7,192,342 B2 * 3/2007 Shoemaker, Jr. ..... A63F 9/30 273/138.3
8,267,405 B1 * 9/2012 Tsai ..... G07F 17/3297 273/454
9,754,460 B2 * 9/2017 Sato ..... A63F 3/0645
10,249,148 B2 * 4/2019 Chu ..... G07F 17/3297
2004/0048659 A1 * 3/2004 Seelig ..... G07F 17/3267 463/25
2011/0086687 A1 * 4/2011 Guarnieri ..... G07F 17/32 463/7

FOREIGN PATENT DOCUMENTS

JP 2004113666 A * 4/2004
JP 2008109995 A * 5/2008
TW M567658 U 10/2018

OTHER PUBLICATIONS

English machine translation of JP 2008-109995 A (Year: 2008).*

(Continued)

*Primary Examiner* — Laura Davison
(74) *Attorney, Agent, or Firm* — WPAT, PC

(57) ABSTRACT

A claw machine and a control method thereof are provided. The claw machine includes a main body, a grabbing assembly configured to drive a claw to make a grabbing movement, a ball-passage assembly including a cover mounted to a ball-passage zone of the main body and a plurality of stopper units spaced from each other in the ball-passage zone, a plurality of sensor units distributed through the ball-passage zone and configured to generate a sensing signal, and a processor configured to set a game score for each of the plurality of sensor units. The processor controls the claw to operate according to an operating instruction set, receives the sensing signal, and obtains the game score of the corresponding sensor unit to calculate a total score. The processor controls the main body to send out a prize according to the total score.

6 Claims, 8 Drawing Sheets

(56) References Cited

OTHER PUBLICATIONS

English machine translation of JP 2004-113666 A (Year: 2004).*
"Roulette Wheel Construction", roulettedoc.com/roulette-wheel.htm, archived Mar. 24, 2016 (Year: 2016).*

* cited by examiner

CONTROL METHOD OF CLAW MACHINE

BACKGROUND OF THE INVENTION

1. Field of the Invention

The present invention generally relates to a claw machine and, more particularly, to a claw machine having diverse entertaining effects and a control method thereof.

2. Description of the Related Art

FIG. 1 shows a conventional claw machine 9. The conventional claw machine 9 includes a body 91, a grabbing mechanism 92 and a light-emitting element 93. The body 91 has a compartment 94 receiving a desk 95. The grabbing mechanism 92 includes a base 92*a* mounted to the body 91, and a grabbing member 92*b* mounted to the base 92*a* and configured to move toward the desk 95 in a first direction. The light-emitting element 93 is mounted to the base 92*a* and is configured to shine a light beam to the desk 95. Thus, the user is able to align the grabbing member 92*b* with a prize through the light beam from the light-emitting element 93. An example of such a conventional claw machine 9 is disclosed in Taiwan Patent No. M567658 entitled "game machine."

The game mode of the above conventional claw machine 9 is simple and monotonous, leading to a lack of diversity. As a result, the users tend to feel bored and lose their interest in playing the claw machine.

In light of this, it is necessary to improve the conventional claw machine.

SUMMARY OF THE INVENTION

It is therefore the objective of this invention to provide a claw machine with diverse entertaining effects.

It is another objective of this invention to provide a control method of the claw machine which increases the difficulty in operating the claw machine by introducing more factors that can affect successful grabbing of the prize, thereby enhancing the user's passion for playing the claw machine.

In an aspect, a claw machine including a main body, a grabbing assembly, a ball-passage assembly, a plurality of sensor units and a processor. The main body includes a compartment, a manipulation unit and an output unit. The grabbing assembly is disposed in the compartment and includes a first driving member and a claw coupled to the first driving member. The first driving member is configured to drive the claw to move along an X-Y plane, to move up and down along a Z-axis, and to make a grabbing movement. A ball-passage assembly includes a cover and a plurality of stopper units. The cover is mounted to and spaced from an inner wall of the main body to delimit a ball-passage zone. The ball-passage zone is provided with a ball entrance. The plurality of stopper units is spaced from each other in the ball-passage zone, and two adjacent ones of the plurality of stopper units delimit a pathway for passage of an object. The plurality of sensor units is distributed through the ball-passage zone. Each of the plurality of sensor units includes a sensor configured to generate a sensing signal. The processor is electrically connected to the manipulation unit, the output unit, the grabbing assembly and the sensors. The processor is configured to set a game score for each of the sensors. The processor controls the claw to operate according to an operating instruction set generated by the manipulation unit, receives the sensing signal from the sensor and obtains the game score of the sensor to calculate a total score based on the obtained game score. The processor controls the output unit to send out a prize according to the total score.

In the aspect, a control method of the claw machine, which is applied to controlling the claw machine mentioned above, is provided. The control method includes activating the first driving member according to the operating instruction set to control the claw to move along the X-Y plane, to move up and down along the Z-axis, and to make a grabbing movement, as performed by the processor. The control method includes controlling the claw to move above the ball entrance when the claw grabs the object, and the processor controls the claw to release to permit the object to drop into the ball-passage zone. The control method includes obtaining the game score of one of the sensors of the plurality of sensor units and calculating the total score by the processor when the sensing signal is generated upon the object triggering the one of the sensors of the plurality of sensor units. The control method also includes controlling the output unit to send out the prize according to the total score by the processor.

Accordingly, the claw machine and the control method thereof according to the present invention are able to arrange a ball-passage zone in the ball-passage assembly and to permit the object picked by the claw to fall into the ball-passage zone. In this regard, through the arrangement of the plurality of stopper units forming pathways in the ball-passage zone, the object passes through some of the pathways in a random manner. As a result, a corresponding sensor is triggered to generate a sensing signal as the object passes through the corresponding pathway, thereby obtaining the game scores corresponding to the triggered sensors and therefore obtaining the prize. As such, the claw machine and the control method thereof according to the invention can provide an enhanced entertaining effect.

In an example, the plurality of stopper units is coupled to the cover or the inner wall. Thus, the plurality of stopper units is able to be arranged in a suitable position according to the structure of the main body, which enhances the convenience in installation and maintenance of the stopper units.

The claw machine further includes a desk unit disposed on a bottom of the compartment and including a tray and a second driving member. The object is placed on the tray. The second driving member is electrically connected to the processor and is configured to rotate the tray. Thus, the location of the object can keep changing due to the rotation of the tray. The user needs to perform more technical operation to get the desired object. In this regard, the entertaining effect of the claw machine is enhanced.

In the example, the bottom of the compartment is in a form of a funnel having a dimension reducing from an outer portion towards a center of the compartment. The center is provided with a hole for arrangement of the desk unit. Thus, the object from a ball exit can easily fall into the tray instead of staying outside the tray.

The claw machine further includes a sensing element disposed in the compartment and electrically connected to the processor. The sensing element is configured to obtain a reward score by way of sensing, and the reward score is stored in an electronic tag attached to the object. Thus, the processor is able to get the reward score carried by the electronic tag by the sensing element sensing the electronic tag on the object.

In the example, a desk unit is disposed on a bottom of the compartment and includes a tray and a second driving member. The object is placed on the tray. The second driving member is electrically connected to the processor. The control method further includes setting the processor to control the second driving member to operate and thereby rotating the tray when the claw machine is activated. Thus, the location of the object can keep changing due to the rotation of the tray. The user needs to perform more technical operation to get the desired object. In this regard, the entertaining effect of the claw machine is enhanced.

In the example, the processor is electrically connected to a sensing element. The sensing element is disposed in the compartment and is configured to obtain a reward score by way of sensing, where the reward score is stored in an electronic tag attached to the object. The control method further includes controlling the claw to move to the sensing element in order to obtain the reward score by way of sensing and adding the reward score and the game score to calculate a total score when the claw grabs the object and before the claw releases, as performed by the processer. Thus, the processor is able to get the reward score carried by the electronic tag by the sensing element sensing the electronic tag on the object.

In the example, an opening of the ball entrance is larger than the object. The control method further includes controlling the claw to move above the ball entrance and back and forth along an X-axis by the processor, and controlling the claw to release by the processor after the processor receives a releasing signal from the manipulation unit. Thus, the user is able to control the manipulation unit to generate the releasing signal after the claw reaching a desired position, in order to drop the object into the ball-passage zone from a desired position above the ball entrance.

In the example, each of the plurality of sensor units includes a display element. The display element is configured to show the game score given to the user at the time the corresponding sensor is triggered. The control method further includes setting the game score as a random value within a range and giving a time series as a random seed by the processor. The game score keeps changing until the processor receives a releasing signal from the manipulation unit. The game score is shown on the display element. Thus, the user is able to observe the game score from the display element, and to control the manipulation unit to generate the releasing signal when a high score is shown. In this regard, it is possible for the processor to set the high score to the sensor, which increases the challenges in playing the claw machine.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
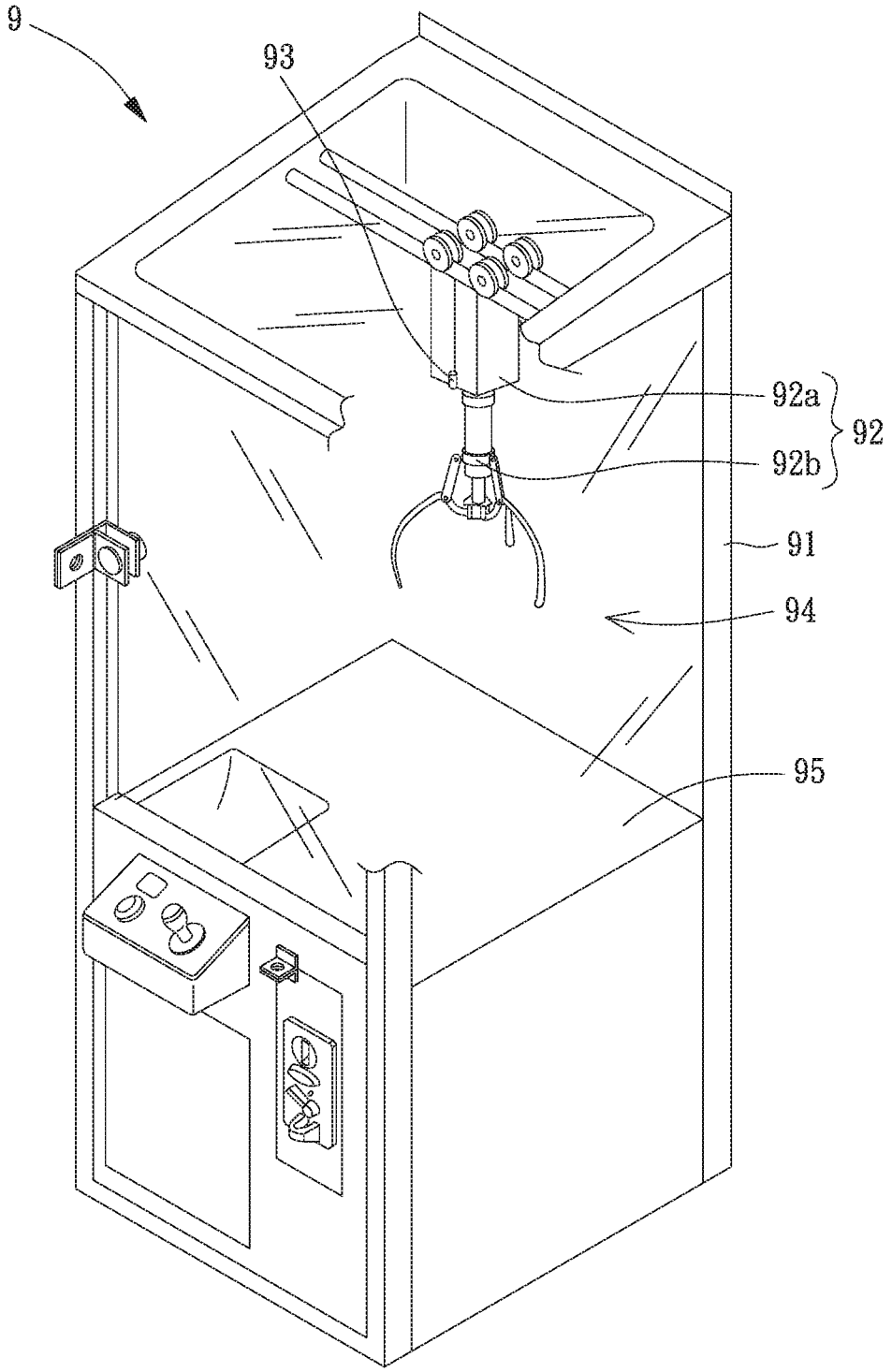
FIG. 1 PRIOR ART
FIG. 1 is a perspective view of a conventional claw machine.

In the various figures of the drawings, the same numerals designate the same or similar parts. Furthermore, when the term "first", "second", "inner", "front", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
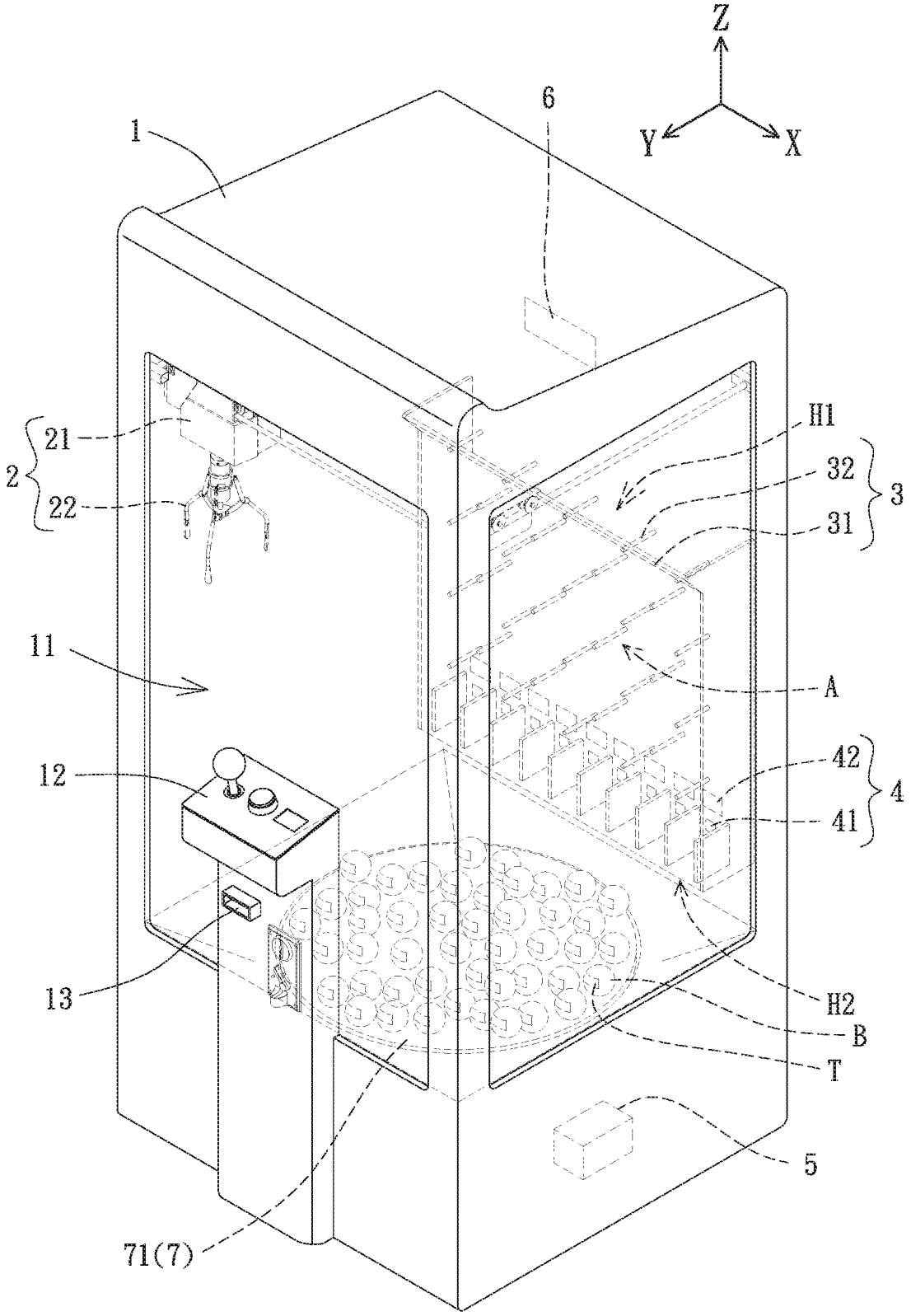
FIG. 2 is a perspective view of a claw machine according to an embodiment of the present invention.

FIG. 2 shows a claw machine of an embodiment according to the present invention, which includes a main body 1, a grabbing assembly 2, a ball-passage assembly 3, a plurality of sensor units 4 and a processor 5. The grabbing assembly 2, the ball-passage assembly 3 and the plurality of sensor units 4 are respectively disposed on the main body 1. The processor 5 is electrically connected to the grabbing assembly 2 and the plurality of sensor units 4.

The main body 1 has a compartment 11 in which at least one object B is placed for grabbing purposes. In this embodiment, the object B is in the form of a ball, such as a ball-shaped capsule toy. The main body 1 further includes a manipulation unit 12 used for controlling a related component (e.g. the claw) of the main body 1, such as a touch-screen, a joystick, a bottom or any combination thereof. Preferably, the manipulation unit 12 is a device with a human-computer interface and internet accessibility to permit the user to remotely control the related component of the main body 1 through the Internet.

The main body 1 includes an output unit 13 configured to send out a prize (e.g. a physical ticket or virtual points). Preferably, the output unit 13 is configured to send out a game score. For example, the output unit 13 may be an arcade ticket machine, a voucher dispenser or a wireless communication module for dispensing the prize. On the other hand, the output unit 13 may be a display configured to show the game score. The display may also show a number of the remaining games and/or a remaining game time along with the game score at the same time.

The grabbing assembly 2 is disposed in the compartment 11 and includes a first driving member 21 and a claw 22 coupled to the first driving member 21. The first driving member 21 is configured to drive the claw 22 to move along an X-Y plane, to move up and down along a Z-axis, and to make a grabbing movement. For example, the claw 22 can be a large claw, a middle-sized claw, a small claw or a mini claw. The quantity of the fingers of the claw 22 can be two, three, four or more. In this embodiment, the claw 22 is a middle-sized claw with three fingers for explanation purposes. The size of the claw 22 and the quantity of the fingers thereof are not used to limit the present invention.

It is noted that when the claw 22 is closed, the space between the fingers of the claw 22 is enough for containing at least one of the objects B. In other words, the claw 22 is able to grab at least one of the objects B at once as it can be readily appreciated by any person having ordinary skill in the art.

Figure 3:
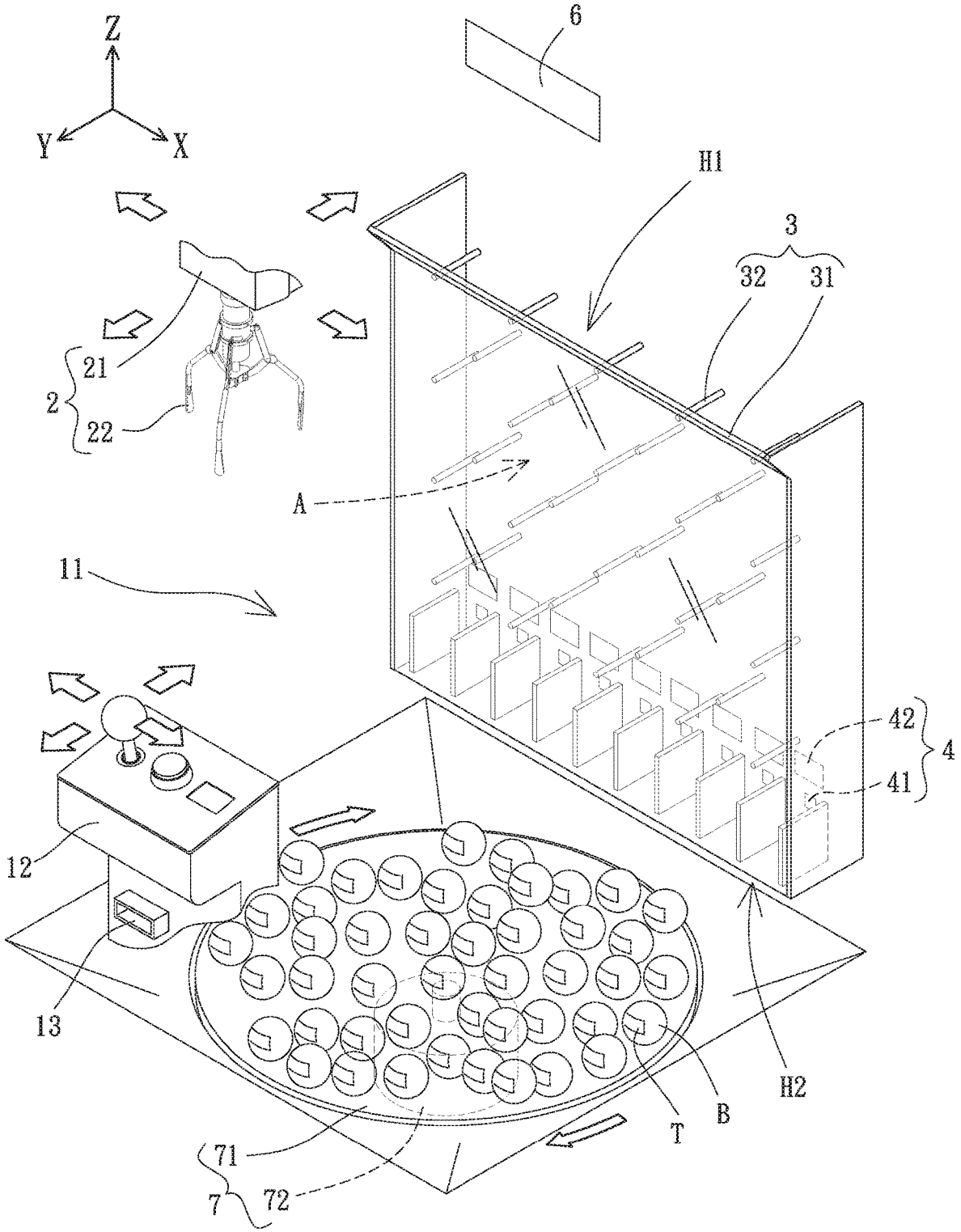
FIG. 3 is a partial perspective view of the claw machine according to the embodiment of the present invention.

With reference to FIGS. 2 and 3, the ball-passage assembly 3 includes a cover 31 which can be a transparent board made of acrylic but is not limited thereto. The cover 31 is mounted to and spaced from an inner wall of the main body 1 to delimit a ball-passage zone A therebetween. The ball-passage zone A has a ball entrance H1 having an opening facing upwards in the compartment 11. Preferably, the ball-passage zone A further has a ball exit H2 intercommunicating with the ball entrance H1. The ball exit H2 as an opening can be arranged toward the bottom of the compartment 11, or can be arranged toward either lateral side of the compartment 11. In this embodiment, the ball exit H2 is arranged toward the bottom of the compartment 11. The openings of the ball entrance H1 and the ball exit H2 are large enough for passage of the at least one of the objects B.

The ball-passage assembly 3 further includes a plurality of stopper units 32 spaced from each other and distributed through the ball-passage zone A. The plurality of stopper units 32 is coupled to the cover 31 or to the inner wall. The space between each adjacent stopper units 32 is larger than the largest dimension of the object B to permit the object B to enter and exit the ball-passage zone A. Each two adjacent stopper units 32 delimit a pathway for passage of the object B. In this embodiment, the plurality of stopper units 32 can be in the form of a plurality of skittles, at least two stopper panels, or the combination thereof.

The sensor units 4 are distributed through the ball-passage zone A and are preferably mounted to an inner wall of the ball-passage zone A to prevent the object B from getting stuck in the ball-passage zone A. Each of the plurality of sensor units 4 includes a sensor 41 configured to generate a sensing signal. The sensing signal is generated when the sensor 41 is triggered by the object B. For example, the sensor 41 can be an infrared transceiver or a proximity switch, but is not limited thereto. As mentioned above, when the plurality of stopper units 32 is in the form of at least two stopper panels, the sensor 41 is arranged in the pathway delimited by two adjacent stopper panels to reduce the possibility of the object B triggering the sensor 41. Preferably, each of the plurality of sensor units 4 includes a display element 42. The display element 42 is configured to show the game score or a ratio that is given to the user at the time a corresponding sensor 41 is triggered. For example, the display element 42 is a display panel, which is not a limitation of the present invention.

The processor 5 is electrically connected to the manipulation unit 12, the output unit 13, the grabbing assembly 2 and the plurality of sensors 41. The processor 5 is any electronic device with a data storage function, a computing function and a signal generation function, such as a programmable logic controller (PLC), a digital signal processor (DSP), a micro control unit (MCU) or any circuit board having the mentioned functions. The processor 5 is configured to control the claw 22 to move, ascend, descend or make a grabbing movement according to an operating instruction set generated by the manipulation unit 12. The processor 5 sets a game score for an individual sensor 41, controls the operation of the claw 22 according to the operating instruction set generated by the manipulation unit 12, and obtains the corresponding game scores according to the sensing signals received from the sensors 41. As a result, the processor 5 calculates a total score based on the game scores of the sensors 41, and controls the output unit 13 to send out the prize according to the total score.

Preferably, the claw machine according to the present invention further includes a sensing element 6 disposed in the compartment 11 and electrically connected to the processor 5. In this embodiment, the sensing element 6 is above the ball entrance H1 and configured to obtain a reward score by way of sensing. The reward score is stored in an electronic tag T attached to the object B. In this embodiment, the electronic tag T and the sensing element 6 can be a near-field communicating (NFC) module. It is worth mentioning that the reward scores of the electronic tags T can be different from each other. It is of a preferred case for the user to recognize the reward score of each electronic tag T.

Preferably, the claw machine according the present invention further comprises a desk unit 7 disposed on the bottom of the compartment 11. The desk unit 7 includes a tray 71 on which the object B is placed, as well as a second driving member 72 electrically connected to the processor 5 and configured to rotate the tray 71. Moreover, the bottom of the compartment 11 is in the form of a funnel having a dimension reducing from an outer portion towards a center thereof while forming a hole at the center for arrangement of the desk unit 7. In this manner, the object B from the ball exit H2 can easily fall into the tray 71 without remaining outside the tray 71.

The control method of the claw machine according to the present invention is applied to controlling the claw machine mentioned above. The control method includes a setting step, a grabbing step, a releasing step, a calculation step and an output step. Particularly, the setting step includes setting a game score or a ratio for each of the plurality of sensors 41 by the processor 5. Preferably, the game scores of the plurality of sensors 41 may include a grand reward score (for example, a jackpot). The grand reward score can be a sum of the other game scores, but is not limited thereto.

Figure 4:
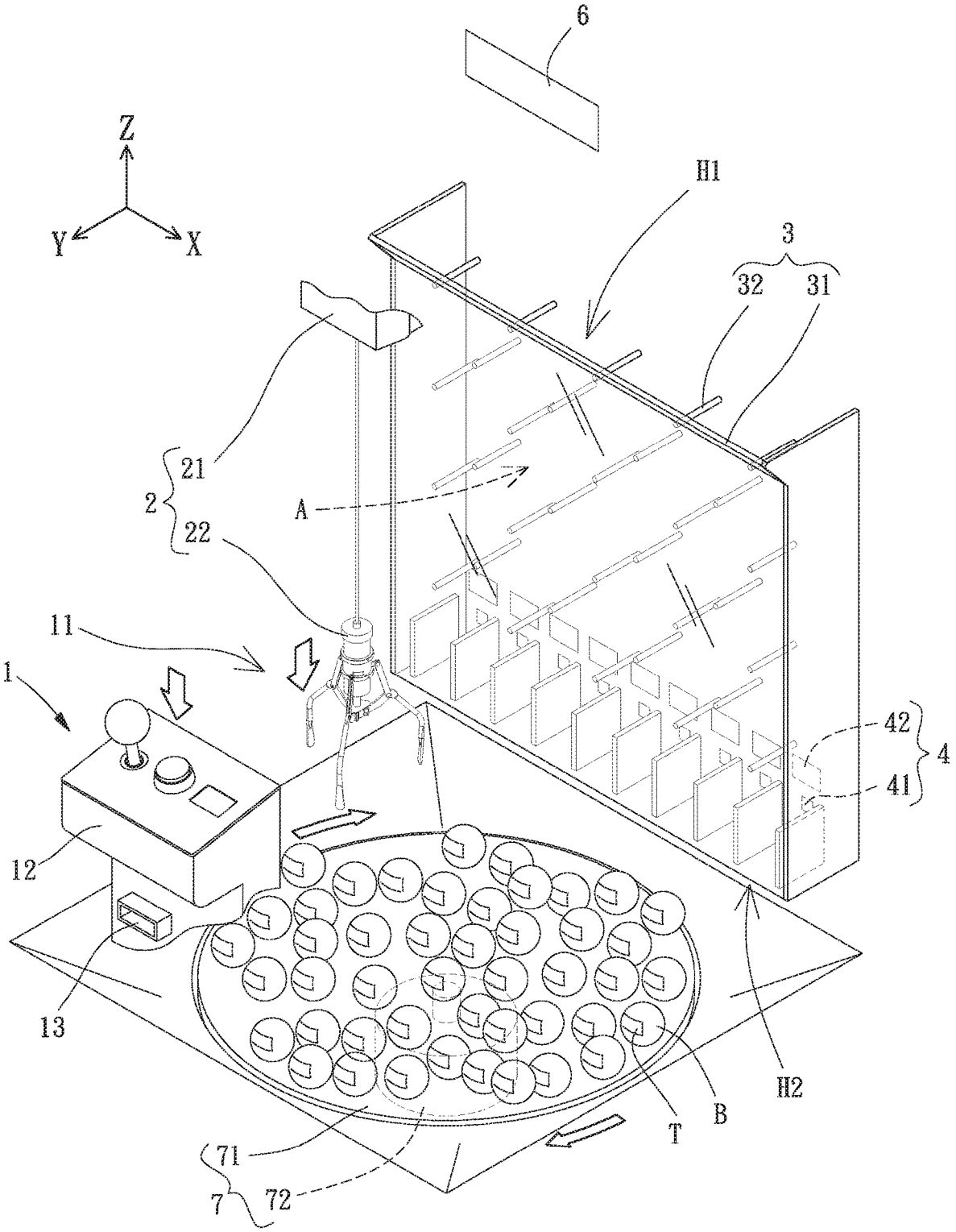
FIG. 4 shows a descending movement of a claw of the claw machine.

With reference to FIGS. 3 and 4, the grabbing step includes activating the first driving member 21 by the processor 5 according to the operating instruction set generated by the user operating the manipulation unit 12. In this regard, the claw 22 is controlled to move along the X-Y plane, to move up and down along the Z-axis, and to make a grabbing movement. The desk unit 7 is preferably disposed at the bottom of the compartment 11. Particularly, the processor 5 is set to control the second driving member 72 of the desk unit 7 to operate when the claw machine is activated, thereby rotating the tray 71. The processor 5 may set that the tray 71 rotates clockwise, counterclockwise, counterclockwise and then clockwise, or clockwise and then counterclockwise. However, this is not used to limit the present invention.

Figure 5:
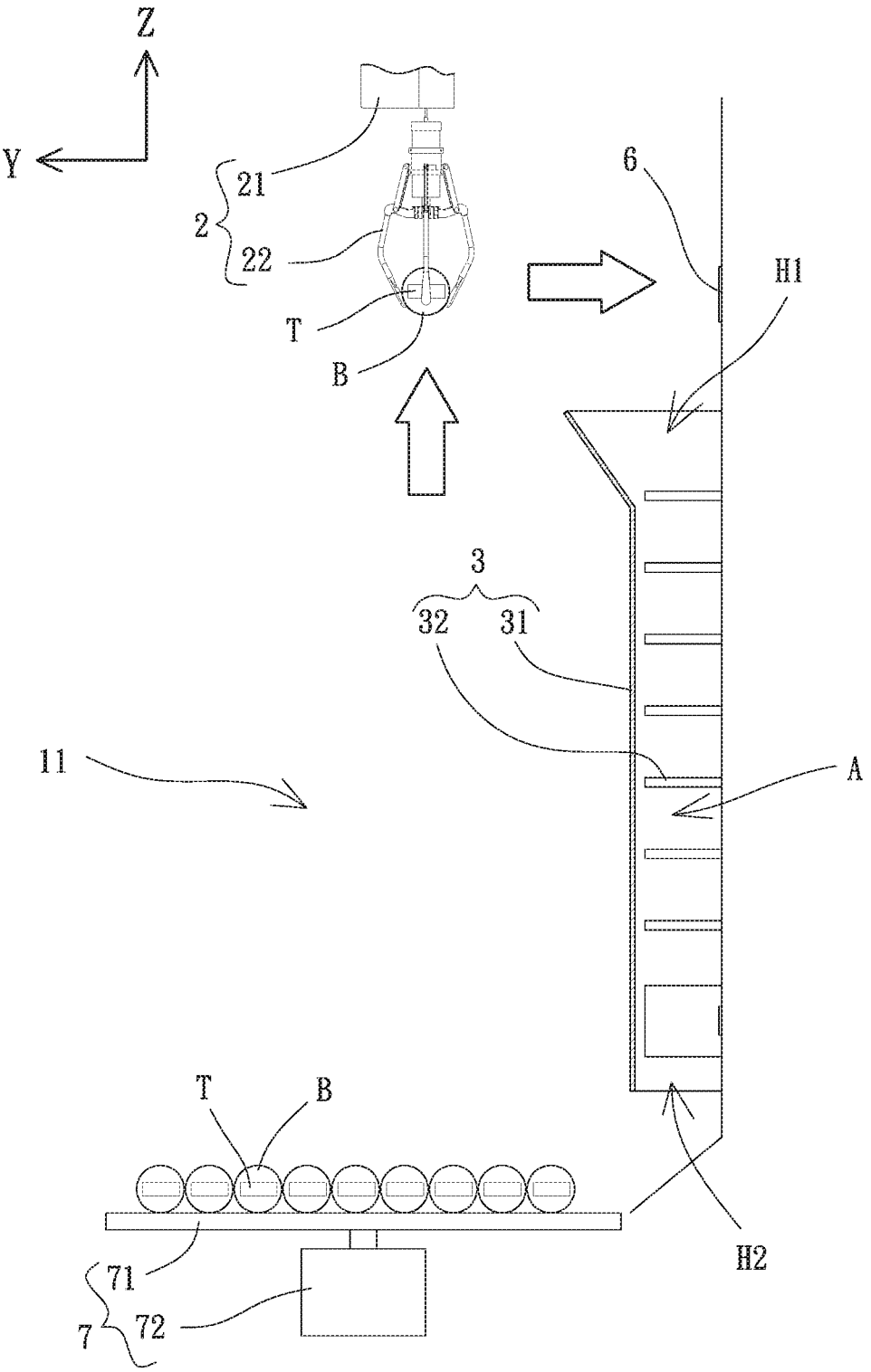
FIG. 5 is a partial side view of the claw machine according to the embodiment of the present invention.
Figure 6:
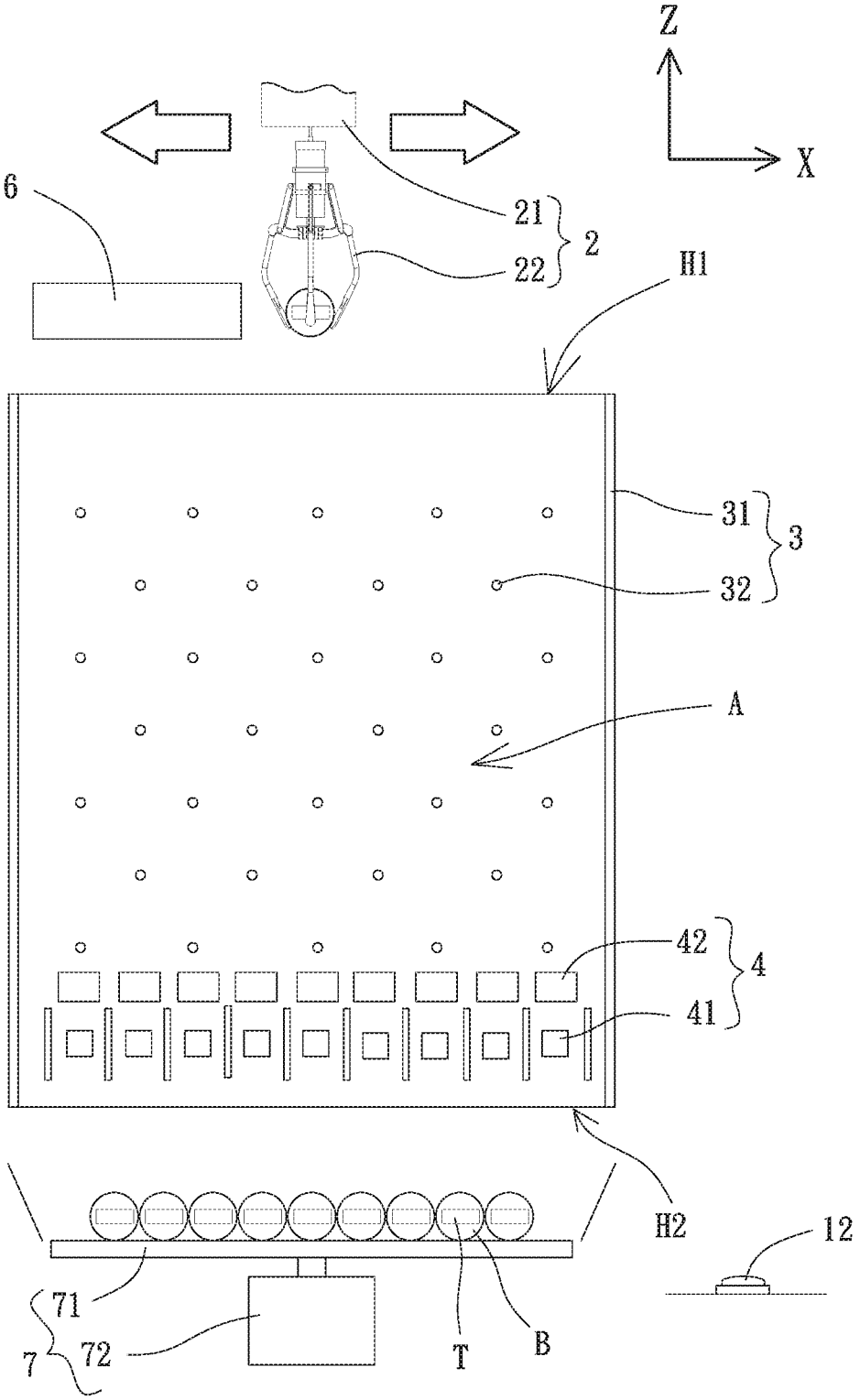
FIG. 6 is a front view of the claw machine according to the embodiment of the present invention.
Figure 7:
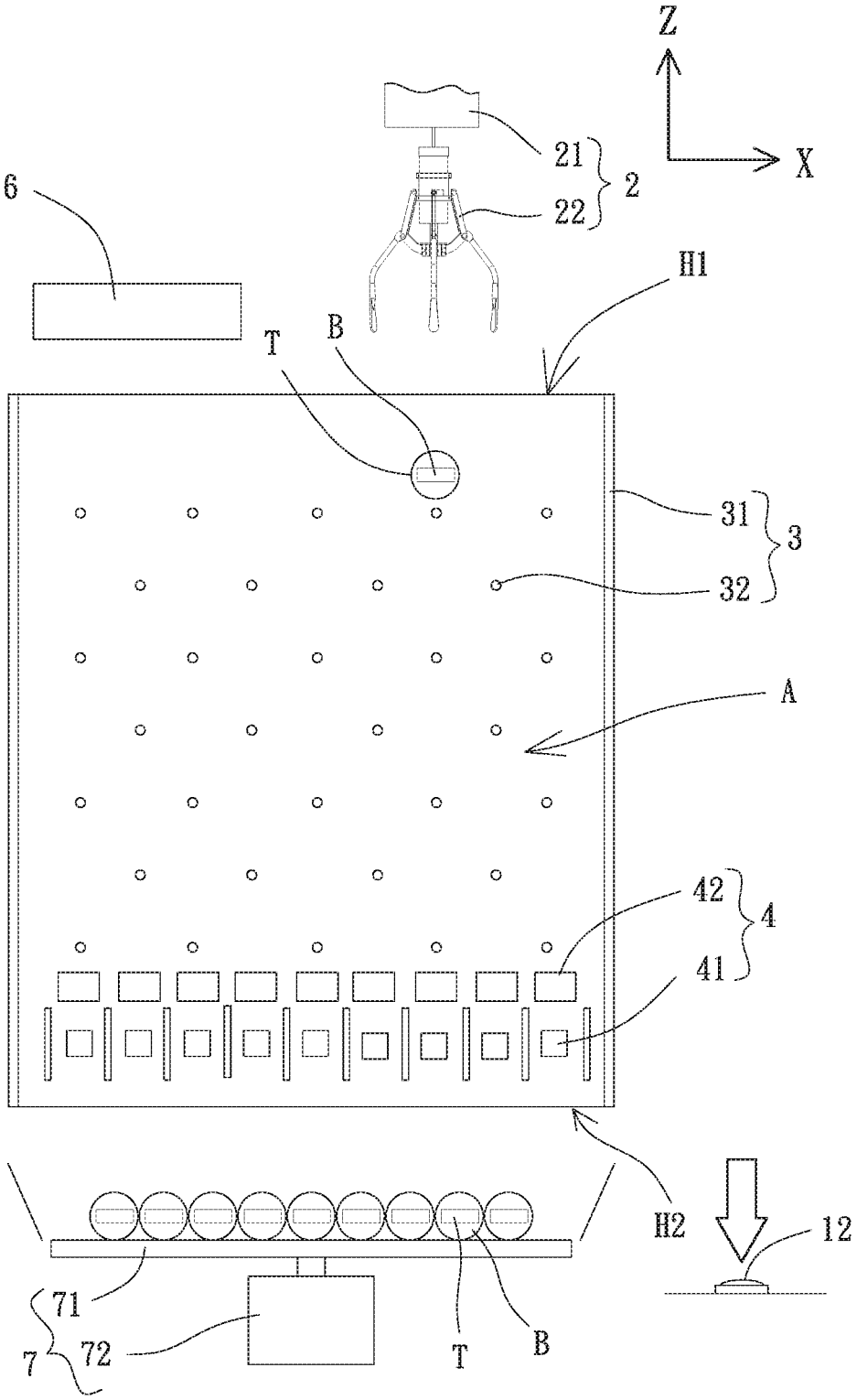
FIG. 7 shows an object falling down into a ball-passage zone from the claw.

With reference to FIGS. 5-7, the releasing step includes controlling the claw 22 to move above the ball entrance H1 by the processor 5 when the claw 22 successfully grabs at least one of the objects B. The releasing step further includes controlling the claw 22 to move to the sensing element 6 by the processor 5 in order for the sensing element 6 to obtain a reward score of the object B by ways of sensing. The processor 5 adds the reward score and the game score to calculate a total score. Preferably, the processor 5 further controls the claw 22 above the ball entrance H1 to move back and forth along the X-axis if the opening of the ball entrance H1 is larger than the object B. Then, the processor 5 controls the claw 22 to release after receiving a releasing signal from the manipulation unit 12. Thus, the object B can drop into the ball-passage zone A from a desired position above the ball entrance H1.

It is noted that the game score of each of the plurality of sensors 41 set by the setting step can keep changing until the processor 5 receives the releasing signal. For example, the processor 5 sets the game score as a random value within a range, and gives a time series as a random seed for randomizing the game score. Thus, the processor 5 can keep changing the game score of each of the plurality of sensors 41, and the display element 42 will show the game score of the corresponding sensor 41.

Figure 8:
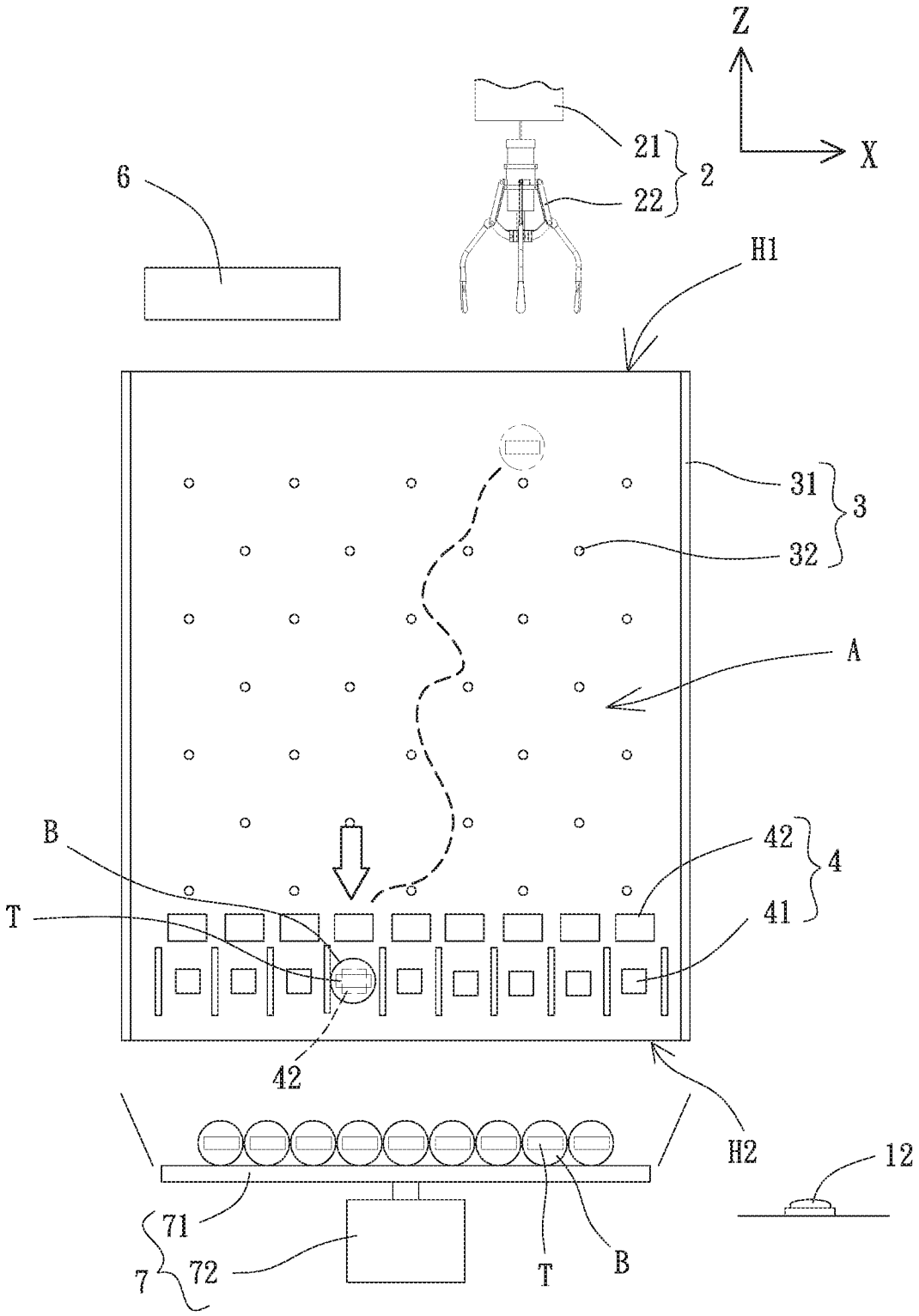
FIG. 8 shows a falling movement of the object in FIG. 7.

With reference to FIG. 8, the calculation step includes obtaining the game score of the sensor 41 by the processor 5 when the sensing signal is generated upon the object B triggering the sensor 41, thus calculating a total score. The game score of the sensor 41 may be a ratio. For example, when the ratio of the triggered sensor 41 set by the processor 5 is double, the processor 5 can double the game score of the object B or double the total score instantly obtained. However, this is not used to limit the present invention.

The output step includes controlling the output unit 13 to send out a prize by the processor 5 according to the total score. When the output unit 13 is an arcade ticket machine, the output unit 13 is able to send out arcade tickets equivalent to the total score. When the output unit 13 is a voucher dispenser, the output unit 13 is able to send out a voucher with a digital barcode (for example, a quick response code, QR code). The digital barcode stores the total score or digital information for prize exchange. When the output unit 13 is a wireless communication module, the output unit 13 is able to send out the virtual points equivalent to the total score or the digital information for prize exchange to an application (App) installed on a mobile device of the user.

In view of the foregoing, the claw machine and the control method thereof according to the present invention are able to arrange a ball-passage zone in the ball-passage assembly and to permit the object picked by the claw to fall into the ball-passage zone. In this regard, through the arrangement of the plurality of stopper units forming pathways in the ball-passage zone, the object passes through some of the pathways in a random manner. As a result, a corresponding sensor is triggered to generate a sensing signal as the object passes through the corresponding pathway, thereby obtaining the game scores corresponding to the triggered sensors and therefore obtaining the prize. As such, the claw machine and the control method thereof according to the invention can provide an enhanced entertaining effect.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A control method for controlling a claw machine, comprising:

activating a first driving member according to an operating instruction set to control a claw to move along an X-Y plane, to move up and down along a Z-axis, and to make a grabbing movement, as performed by a processor;

controlling the claw to move above a ball entrance and back and forth along an X-axis by the processor when the claw grabs an object;

controlling the claw to release to permit the object to drop into a ball-passage zone by the processor after the processor receives a releasing signal from a manipulation unit;

setting a game score for each of a plurality of sensors of a plurality of sensor units distributed throughout the ball-passage zone;

obtaining the game score of one of the sensors of the plurality of sensor units and calculating a total score by the processor when a sensing signal is generated upon the object triggering the one of the sensors of the plurality of sensor units; and controlling an output unit to send out a prize according to the total score by the processor;

wherein the claw machine includes:

a main body including a compartment, the manipulation unit and the output unit;

a grabbing assembly disposed in the compartment and including the first driving member and the claw coupled to the first driving member;

a ball-passage assembly including a cover and a plurality of stopper units, wherein the cover is mounted to and spaced from an inner wall of the main body to delimit the ball-passage zone, wherein the ball-passage zone is provided with the ball entrance, wherein an opening of the ball entrance is larger than the object, wherein the plurality of stopper units is spaced from each other in the ball-passage zone, and wherein two adjacent ones of the plurality of stopper units delimit a pathway for passage of the object;

the plurality of sensor units distributed through the ball-passage zone, wherein each of the plurality of sensor units includes one of the plurality of sensors configured to generate the sensing signal; and the processor electrically connected to the manipulation unit, the output unit, the grabbing assembly and the sensors, wherein the processor is configured to set the game score for each of the sensors.

2. The control method of the claw machine as claimed in claim 1, wherein a desk unit is disposed on a bottom of the compartment and includes a tray and a second driving member, wherein the object is placed on the tray, wherein the second driving member is electrically connected to the processor, and wherein the control method further includes:

setting the processor to control the second driving member to operate and thereby rotating the tray when the claw machine is activated.

3. The control method of the claw machine as claimed in claim 1, wherein the processor is electrically connected to a sensing element, wherein the sensing element is disposed in the compartment and is configured to obtain a reward score by way of sensing, wherein the reward score is stored in an electronic tag attached to the object, and wherein the control method further includes:

controlling the claw to move to the sensing element in order to obtain the reward score by way of sensing and adding the reward score and the game score to calculate the total score when the claw grabs the object and before the claw releases, as performed by the processer.

4. A control method for controlling a claw machine comprising:

activating a first driving member according to an operating instruction set to control a claw to move along an X-Y plane, to move up and down along a Z-axis, and to make a grabbing movement, as performed by a processor;

controlling the claw to move above a ball entrance when the claw grabs an object;

setting a game score for each of a plurality of sensors of a plurality of sensor units distributed throughout a ball-passage zone as a random value within a range and giving a time series as a random seed by the processor, wherein the game score keeps changing until the processor receives a releasing signal from a manipulation unit, and wherein the game score is shown on a display element;

controlling the claw to release to permit the object to drop into the ball-passage zone by the processor after the processor receives the releasing signal from the manipulation unit;

obtaining the game score of one of the sensors of the plurality of sensor units and calculating a total score by the processor when a sensing signal is generated upon the object triggering the one of the sensors of the plurality of sensor units; and controlling an output unit to send out a prize according to the total score by the processor;

wherein the claw machine includes:

a main body including a compartment, the manipulation unit and the output unit;

a grabbing assembly disposed in the compartment and including the first driving member and the claw coupled to the first driving member;

a ball-passage assembly including a cover and a plurality of stopper units, wherein the cover is mounted to and spaced from an inner wall of the main body to delimit the ball-passage zone, wherein the ball-passage zone is provided with the ball entrance, wherein the plurality of stopper units is spaced from each other in the ball-passage zone, and wherein two adjacent ones of the plurality of stopper units delimit a pathway for passage of the object;

the plurality of sensor units distributed through the ball-passage zone, wherein each of the plurality of sensor units includes one of the plurality of sensors configured to generate the sensing signal, wherein each of the plurality of sensor units includes the display element, wherein the display element is configured to show the game score given to the user at the time the corresponding sensor is triggered; and the processor electrically connected to the manipulation unit, the output unit, the grabbing assembly and the sensors, wherein the processor is configured to set the game score for each of the sensors.

5. The control method of the claw machine as claimed in claim 4, wherein a desk unit is disposed on a bottom of the compartment and includes a tray and a second driving member, wherein the object is placed on the tray, wherein the second driving member is electrically connected to the processor, and wherein the control method further includes:

setting the processor to control the second driving member to operate and thereby rotating the tray when the claw machine is activated.

6. The control method of the claw machine as claimed in claim 4, wherein the processor is electrically connected to a sensing element, wherein the sensing element is disposed in the compartment and is configured to obtain a reward score by way of sensing, wherein the reward score is stored in an electronic tag attached to the object, and wherein the control method further includes:

controlling the claw to move to the sensing element in order to obtain the reward score by way of sensing and adding the reward score and the game score to calculate the total score when the claw grabs the object and before the claw releases, as performed by the processer.

* * * * *